US009689286B2

(12) United States Patent
Haltiner, Jr.

(10) Patent No.: US 9,689,286 B2
(45) Date of Patent: Jun. 27, 2017

(54) CAMSHAFT PHASER WITH POSITION CONTROL VALVE

(71) Applicant: DELPHI TECHNOLOGIES, INC., Troy, MI (US)

(72) Inventor: Karl J. Haltiner, Jr., Fairport, NY (US)

(73) Assignee: DELPHI TECHNOLOGIES, INC., Troy, MI (US)

( * ) Notice: Subject to any disclaimer, the term of this patent is extended or adjusted under 35 U.S.C. 154(b) by 287 days.

(21) Appl. No.: 14/554,385

(22) Filed: Nov. 26, 2014

(65) Prior Publication Data

US 2016/0146067 A1 May 26, 2016

(51) Int. Cl.

| | |
|---|---|
| ***F01L 1/34*** | (2006.01) |
| ***F01L 1/344*** | (2006.01) |
| ***F04C 2/344*** | (2006.01) |

(52) U.S. Cl.

CPC ..... *F01L 1/3442* (2013.01); *F04C 2/3448* (2013.01); *F01L 2001/34423* (2013.01); *F01L 2001/34426* (2013.01); *F01L 2001/34433* (2013.01)

(58) Field of Classification Search

CPC ..... F01L 1/3442; F01L 2001/34423; F01L 2001/34426; F01L 2001/34433; F04C 2/3448

See application file for complete search history.

(56) References Cited

U.S. PATENT DOCUMENTS

| | | | |
|---|---|---|---|
| 5,507,254 | A | 4/1996 | Melchior |
| 5,645,017 | A | 7/1997 | Melchior et al. |
| 5,649,506 | A | 7/1997 | Melchior et al. |
| 7,523,728 | B2 | 4/2009 | Berndorfer |
| 8,534,246 | B2 | 9/2013 | Lichti et al. |
| 2007/0039581 | A1 | 2/2007 | Berndorfer |

FOREIGN PATENT DOCUMENTS

| | | | |
|---|---|---|---|
| GB | 2487227 | A1 | 7/2012 |

OTHER PUBLICATIONS

EP Search Report, EP Application 15194345, Dated Mar. 17, 2016.

*Primary Examiner* — Zelalem Eshete
(74) *Attorney, Agent, or Firm* — Joshua M. Haines

(57) ABSTRACT

A camshaft phaser includes an input member connectable to the crankshaft of the internal combustion engine; an output member connectable to the camshaft of the internal combustion engine and defining an advance chamber and a retard chamber with the input member; a valve spool coaxially disposed within the output member such that the valve spool is rotatable relative to the output member and the input member, the valve spool defining a supply chamber and a vent chamber with the output member; and an actuator which rotates the valve spool in order to change the position of the output member relative to the input member by supplying pressurized oil from the supply chamber to one of the advance chamber and the retard chamber and venting oil to the vent chamber from the other of the supply chamber and the advance chamber.

17 Claims, 11 Drawing Sheets

CAMSHAFT PHASER WITH POSITION CONTROL VALVE

TECHNICAL FIELD OF INVENTION

The present invention relates to a camshaft phaser for varying the phase relationship between a crankshaft and a camshaft in an internal combustion engine; more particularly to such a camshaft phaser which is a vane-type camshaft phaser; even more particularly to a vane-type camshaft phaser which includes a control valve in which the position of the control valve determines the phase relationship between the crankshaft and the camshaft.

BACKGROUND OF INVENTION

A typical vane-type camshaft phaser for changing the phase relationship between a crankshaft and a camshaft of an internal combustion engine generally comprises a plurality of outwardly-extending vanes on a rotor interspersed with a plurality of inwardly-extending lobes on a stator, forming alternating advance and retard chambers between the vanes and lobes. Engine oil is selectively supplied to one of the advance and retard chambers and vacated from the other of the advance chambers and retard chambers by a phasing oil control valve in order to rotate the rotor within the stator and thereby change the phase relationship between the camshaft and the crankshaft. One such camshaft phaser is described in U.S. Pat. No. 8,534,246 to Lichti et al., the disclosure of which is incorporated herein by reference in its entirety and hereinafter referred to as Lichti et al. As is typical for phasing oil control valves, the phasing oil control valve of Lichti et al. operates on the principle of direction control, i.e. the position of the oil control valve determines the direction of rotation of the rotor relative to the stator. More specifically, when a desired phase relationship between the camshaft and the crankshaft is determined, the desired phase relationship is compared to the actual phase relationship as determined from the outputs of a camshaft position sensor and a crankshaft position sensor. If the actual phase relationship, does not match the desired phase relationship, the oil control valve is actuated to either 1) an advance position to supply oil to the retard chambers and vent oil from the advance chambers or 2) a retard position to supply oil to the advance chambers and vent oil from the retard chambers until the actual phase relationship matches the desired phase relationship. When the actual phase relationship matches the desired phase relationship, the oil control valve is positioned to hydraulically lock the rotor relative to the stator. However, leakage from the advance chambers and the retard chambers or leakage from the oil control valve may cause the phase relationship to drift over time. When the drift in phase relationship is detected by comparing the actual phase relationship to the desired phase relationship, the oil control valve must again be actuated to either the advance position or the retard position in order to correct for the drift, then the oil control valve is again positioned to hydraulically lock the rotor relative to the stator after the correction has been made. Consequently, the position of the rotor relative to the stator is not self-correcting and relies upon actuation of the phasing oil control valve to correct for the drift.

U.S. Pat. No. 5,507,254 to Melchior, hereinafter referred to as Melchior, teaches a camshaft phaser with a phasing oil control valve which allows for self-correction of the rotor relative to the stator as may be necessary due to leakage from the advance chamber or from the retard chamber.

Melchior also teaches that the valve spool defines a first recess and a second recess separated by a rib such that one of the recesses acts to supply oil to the advance chamber when a retard in timing of the camshaft is desired while the other recess acts to supply oil to the retard chamber when an advance in the timing of the camshaft is desired. The recess that does not act to supply oil when a change in phase is desired does not act as a flow path. However, improvements are always sought in any art.

What is needed is a camshaft phaser which minimizes or eliminates one or more the shortcomings as set forth above.

SUMMARY OF THE INVENTION

Briefly described, a camshaft phaser is provided for use with an internal combustion engine for controllably varying the phase relationship between a crankshaft and a camshaft in the internal combustion engine. The camshaft phaser includes an input member connectable to the crankshaft of the internal combustion engine to provide a fixed ratio of rotation between the input member and the crankshaft; an output member connectable to the camshaft of the internal combustion engine and defining an advance chamber and a retard chamber with the input member; a valve spool coaxially disposed within the output member such that the valve spool is rotatable relative to the output member and the input member, the valve spool defining a supply chamber and a vent chamber with the output member; and an actuator which rotates the valve spool in order to change the position of the output member relative to the input member by 1) supplying pressurized oil from the supply chamber to the advance chamber and venting oil from the retard chamber to the vent chamber when retarding the phase relationship of the camshaft relative to the crankshaft is desired and 2) supplying pressurized oil from the supply chamber to the retard chamber and venting oil from the advance chamber to the vent chamber when advancing the phase relationship between the camshaft relative to the crankshaft is desired.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
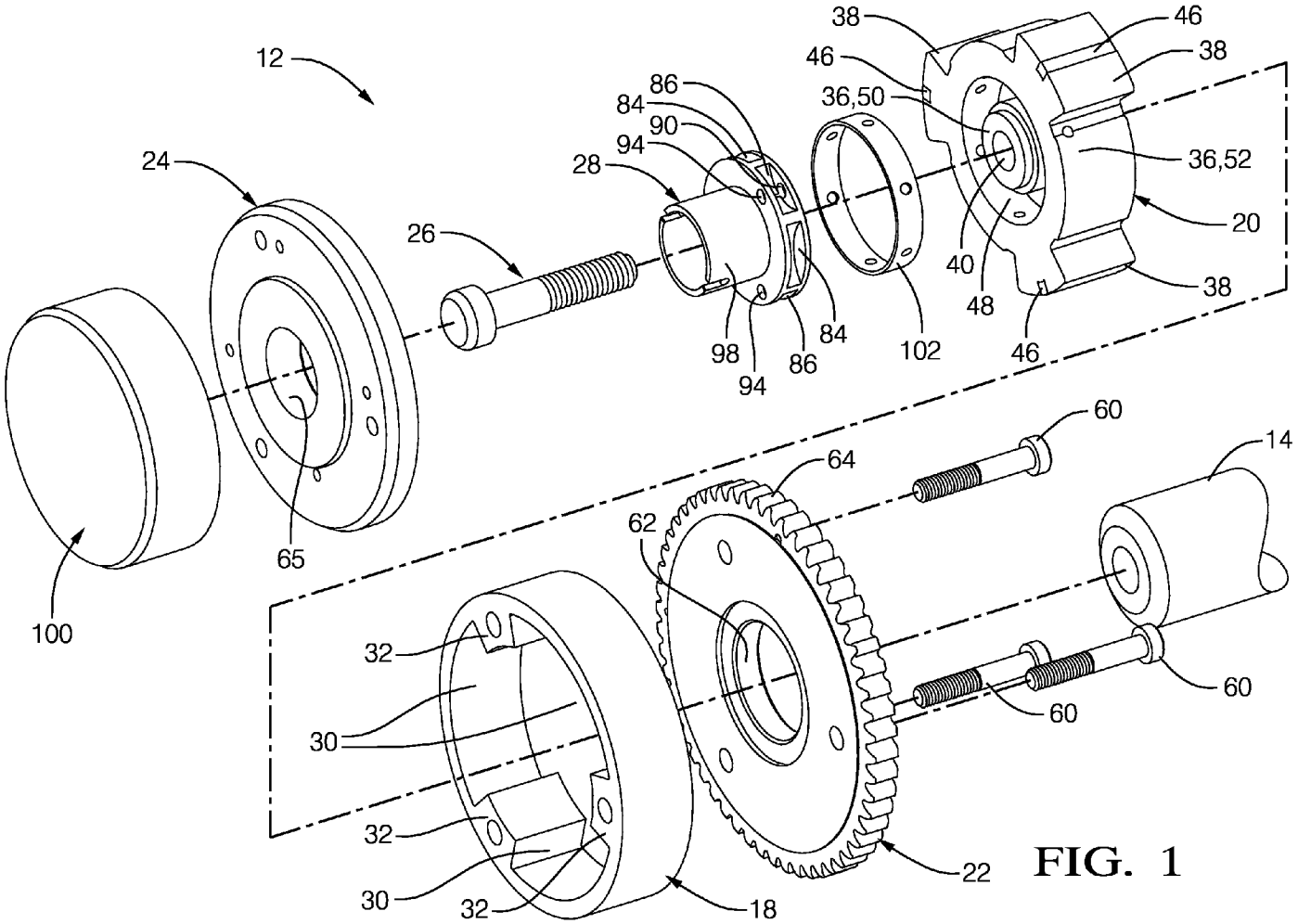
FIG. 1 is an exploded isometric view of a camshaft phaser in accordance with the present invention.
Figure 2:
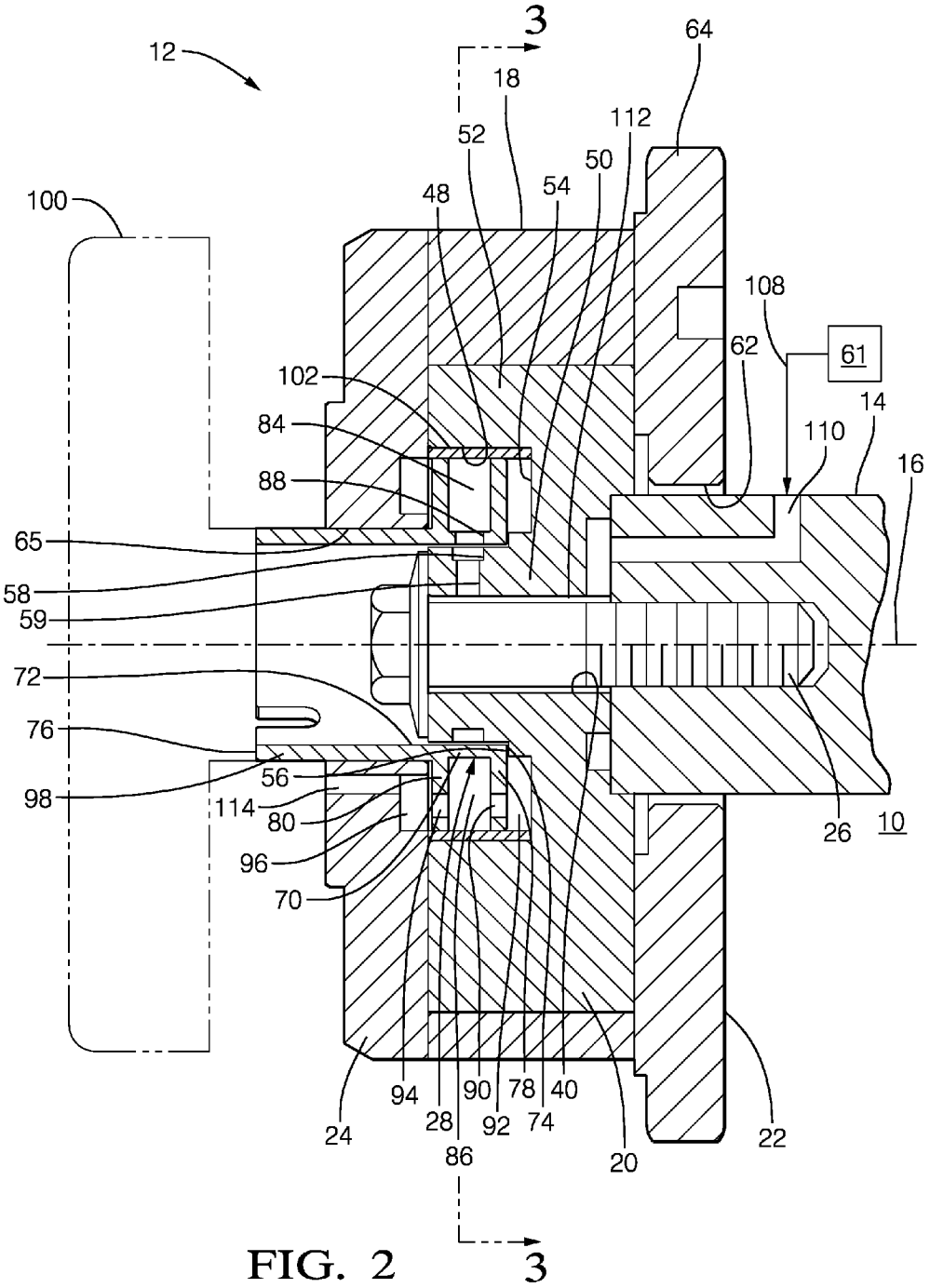
FIG. 2 is an axial cross-section view of the camshaft phaser of FIG. 1.
Figure 3:
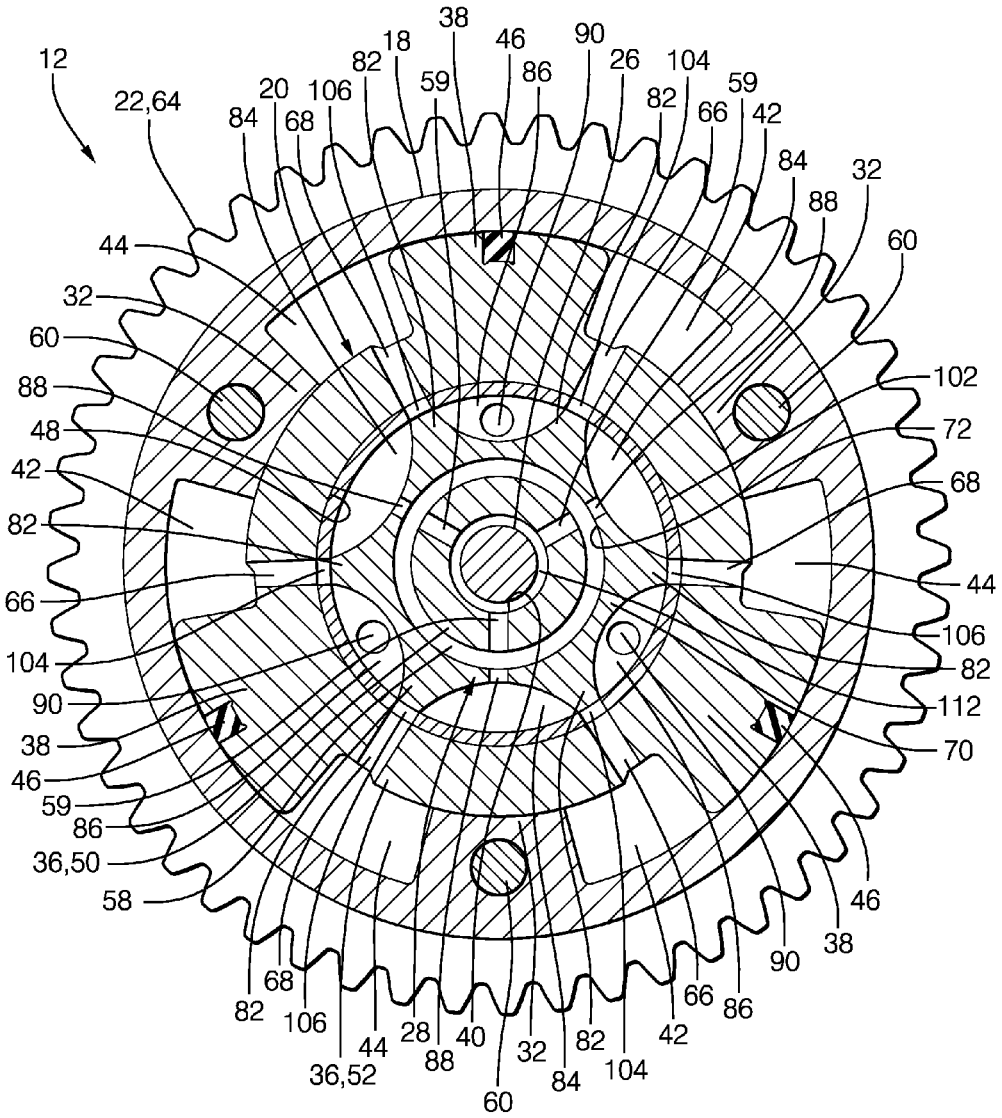
FIG. 3 is a radial cross-sectional view of the camshaft phaser taken through section line 3-3 of FIG. 2 and showing a valve spool of the camshaft phaser in a hold position which maintains a rotational position of a rotor of the camshaft phaser relative to a stator of the camshaft phaser.

In accordance with a preferred embodiment of this invention and referring to FIGS. 1-3, an internal combustion engine 10 is shown which includes a camshaft phaser 12. Internal combustion engine 10 also includes a camshaft 14 which is rotatable about a camshaft axis 16 based on rotational input from a crankshaft and chain (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing or phase between the crankshaft and camshaft 14 to be varied. In this way, opening and closing of the intake and/or exhaust valves can be advanced or retarded in order to achieve desired engine performance.

Camshaft phaser 12 generally includes a stator 18 which acts as an input member, a rotor 20 disposed coaxially within stator 18 which acts as an output member, a back cover 22 closing off one axial end of stator 18, a front cover 24 closing off the other axial end of stator 18, a camshaft phaser attachment bolt 26 for attaching camshaft phaser 12 to camshaft 14, and a valve spool 28. The rotational position of valve spool 28 relative to stator 18 determines the rotational position of rotor 20 relative to stator 18, unlike typical valve spools which move axially to determine only the direction the rotor will rotate relative to the stator. The various elements of camshaft phaser 12 will be described in greater detail in the paragraphs that follow.

Stator 18 is generally cylindrical and includes a plurality of radial chambers 30 defined by a plurality of lobes 32 extending radially inward. In the embodiment shown, there are three lobes 32 defining three radial chambers 30, however, it is to be understood that a different number of lobes 32 may be provided to define radial chambers 30 equal in quantity to the number of lobes 32.

Rotor 20 includes a rotor central hub 36 with a plurality of vanes 38 extending radially outward therefrom and a rotor central through bore 40 extending axially therethrough. The number of vanes 38 is equal to the number of radial chambers 30 provided in stator 18. Rotor 20 is coaxially disposed within stator 18 such that each vane 38 divides each radial chamber 30 into advance chambers 42 and retard chambers 44. The radial tips of lobes 32 are mateable with rotor central hub 36 in order to separate radial chambers 30 from each other. Each of the radial tips of vanes 38 may include one of a plurality of wiper seals 46 to substantially seal adjacent advance chambers 42 and retard chambers 44 from each other. While not shown, each of the radial tips of lobes 32 may also include one of a plurality of wiper seals 46.

Rotor central hub 36 defines an annular valve spool recess 48 which extends part way into rotor central hub 36 from the axial end of rotor central hub 36 that is proximal to front cover 24. As a result, rotor central hub 36 includes a rotor central hub inner portion 50 that is annular in shape and bounded radially inward by rotor central through bore 40 and bounded radially outward by annular valve spool recess 48. Also as a result, rotor central hub 36 includes a rotor central hub outer portion 52 that is bounded radially inward by annular valve spool recess 48 and is bounded radially outward by the radially outward portion of rotor central hub outer portion 52 from which lobes 32 extend radially outward. Since annular valve spool recess 48 extends only part way into rotor central hub 36, annular valve spool recess 48 defines an annular valve spool recess bottom 54 which is annular in shape and extends between rotor central hub inner portion 50 and rotor central hub outer portion 52. As shown, valve spool recess bottom 54 may be stepped, thereby defining a valve spool recess shoulder 56 that is substantially perpendicular to camshaft axis 16. A rotor annular oil supply groove 58 is formed circumferentially on a radially outward surface of rotor central hub inner portion 50 such that a plurality of rotor oil supply passages 59 provides fluid communication between rotor central through bore 40 and rotor annular oil supply groove 58.

Back cover 22 is sealingly secured, using cover bolts 60, to the axial end of stator 18 that is proximal to camshaft 14. Tightening of cover bolts 60 prevents relative rotation between back cover 22 and stator 18. Back cover 22 includes a back cover central bore 62 extending coaxially therethrough. The end of camshaft 14 is received coaxially within back cover central bore 62 such that camshaft 14 is allowed to rotate relative to back cover 22. Back cover 22 may also include a sprocket 64 formed integrally therewith or otherwise fixed thereto. Sprocket 64 is configured to be driven by a chain that is driven by the crankshaft of internal combustion engine 10. Alternatively, sprocket 64 may be a pulley driven by a belt or other any other known drive member known for driving camshaft phaser 12 by the crankshaft. In an alternative arrangement, sprocket 64 may be integrally formed or otherwise attached to stator 18 rather than back cover 22.

Similarly, front cover 24 is sealingly secured, using cover bolts 60, to the axial end of stator 18 that is opposite back cover 22. Cover bolts 60 pass through back cover 22 and stator 18 and threadably engage front cover 24; thereby clamping stator 18 between back cover 22 and front cover 24 to prevent relative rotation between stator 18, back cover 22, and front cover 24. In this way, advance chambers 42 and retard chambers 44 are defined axially between back cover 22 and front cover 24. Front cover 24 includes a front cover central bore 65 extending coaxially therethrough.

Camshaft phaser 12 is attached to camshaft 14 with camshaft phaser attachment bolt 26 which extends coaxially through rotor central through bore 40 of rotor 20 and threadably engages camshaft 14, thereby by clamping rotor 20 securely to camshaft 14. More specifically, rotor central hub inner portion 50 is clamped between the head of camshaft phaser attachment bolt 26 and camshaft 14. In this way, relative rotation between stator 18 and rotor 20 results in a change in phase or timing between the crankshaft of internal combustion engine 10 and camshaft 14.

Oil is selectively supplied to retard chambers 44 from an oil source 61, by way of non-limiting example only an oil pump of internal combustion engine 10 which may also provide lubrication to various elements of internal combustion engine 10, and vented from advance chambers 42 in order to cause relative rotation between stator 18 and rotor 20 which results in advancing the timing of camshaft 14 relative to the crankshaft of internal combustion engine 10. Conversely, oil is selectively supplied to advance chambers 42 from oil source 61 and vented from retard chambers 44 in order to cause relative rotation between stator 18 and rotor 20 which results in retarding the timing of camshaft 14 relative to the crankshaft of internal combustion engine 10. Rotor advance passages 66 may be provided in rotor 20 for supplying and venting oil to and from advance chambers 42 while rotor retard passages 68 may be provided in rotor 20 for supplying and venting oil to and from retard chambers 44. Rotor advance passages 66 extend radially outward through rotor central hub outer portion 52 from annular valve spool recess 48 to advance chambers 42 while and rotor retard passages 68 extend radially outward through rotor central hub outer portion 52 from annular valve spool recess 48 to retard chambers 44. Supplying and venting oil to and from advance chambers 42 and retard chambers 44 is controlled by valve spool 28, as will be described in greater detail later, such that valve spool 28 is disposed coaxially and rotatably within annular valve spool recess 48.

Rotor 20 and valve spool 28, which act together to function as a valve, will now be described in greater detail with continued reference to FIGS. 1-3. Valve spool 28 includes a spool central hub 70 with a spool central through bore 72 extending coaxially therethrough. Valve spool 28 is received coaxially within annular valve spool recess 48, and consequently, valve spool 28 radially surrounds camshaft phaser attachment bolt 26. Spool central through bore 72 is sized to mate with rotor central hub inner portion 50 in a close sliding interface such that valve spool 28 is able to freely rotate on rotor central hub inner portion 50 while substantially preventing oil from passing between the interface of spool central through bore 72 and rotor central hub inner portion 50 and also substantially preventing radial movement of valve spool 28 within annular valve spool recess 48. Spool central hub 70 extends axially from a spool hub first end 74 which is proximal to rotor 20 to a spool hub second end 76 which is distal from rotor 20. Valve spool 28 also includes an annular spool base 78 which extends radially outward from spool central hub 70 at spool hub first end 74 such that annular spool base 78 axially abuts valve spool recess shoulder 56. Valve spool 28 also includes an annular spool top 80 which extends radially outward from spool central hub 70 such that annular spool top 80 axially abuts front cover 24 and such that annular spool top 80 is axially spaced from annular spool base 78. Consequently, annular spool base 78 and annular spool top 80 are captured axially between valve spool recess shoulder 56 and front cover 24 such that axial movement of valve spool 28 relative to rotor 20 is substantially prevented. A plurality of valve spool lands 82 extend radially outward from spool central hub 70 in a polar array such that valve spool lands 82 join annular spool base 78 and annular spool top 80, thereby defining a plurality of alternating supply chambers 84 and vent chambers 86 between annular spool base 78 and annular spool top 80. The number of valve spool lands 82 is equal to the sum of the number of advance chambers 42 and the number of retard chambers 44, and as shown in the figures of the described embodiment, there are six valve spool lands 82. Fluid communication between rotor annular oil supply groove 58 and supply chambers 84 is provided through respective spool supply passages 88 which extend radially outward through spool central hub 70 from spool central through bore 72 to spool supply passages 88. Annular spool base 78 includes inner vent passages 90 extending axially therethrough which provide fluid communication between respective vent chambers 86 and an annular volume 92 defined axially between annular valve spool recess bottom 54 and annular spool base 78. Similarly, annular spool top 80 includes outer vent passages 94 extending axially therethrough which provide fluid communication between respective vent chambers 86 and an annular front cover vent groove 96 formed on the axial face of front cover 24 that faces toward rotor 20. Valve spool 28 also includes a valve spool drive extension 98 which extends axially from annular spool top 80 and through front cover central bore 65. Valve spool drive extension 98 is arranged to engage an actuator 100 which is used to rotate valve spool 28 relative to stator 18 and rotor 20 as required to achieve a desired rotational position of rotor 20 relative to stator 18 as will be described in greater detail later. Actuator 100 may be, by way of non-limiting example only, an electric motor which is stationary relative to camshaft phaser 12 and connected to valve spool drive extension 98 through a gear set or an electric motor which rotates with camshaft phaser 12 and which is powered through slip rings. Actuator 100 may be controlled by an electronic controller (not shown) based on inputs from various sensors (not shown) which may provide signals indicative of, by way of non-limiting example only, engine temperature, ambient temperature, intake air flow, manifold pressure, exhaust constituent composition, engine torque, engine speed, throttle position, crankshaft position, and camshaft position. Based on the inputs from the various sensors, the electronic controller may determine a desired phase relationship between the crankshaft and camshaft 14, thereby commanding actuator 100 to rotate valve spool 28 relative to stator 18 and rotor 20 as required to achieve the desired rotational position of rotor 20 relative to stator 18.

A valve spool ring 102 is located radially between valve spool 28 and the portion of annular valve spool recess 48 defined by rotor central hub outer portion 52. Valve spool ring 102 is fixed to rotor 20, for example only, by press fitting valve spool ring 102 with annular valve spool recess 48, such that relative rotation between valve spool ring 102 and rotor 20 is prevented. Valve spool ring 102 is sized to substantially prevent oil from passing between the interface between valve spool ring 102 and annular valve spool recess 48. Valve spool ring 102 includes a plurality of valve spool ring advance passages 104 and a plurality of valve spool ring retard passages 106 which extend radially therethrough. Each valve spool ring advance passage 104 is aligned with a respective rotor advance passage 66 while each valve spool ring retard passage 106 is aligned with a respective rotor retard passage 68. Each valve spool ring advance passage 104 and each valve spool ring retard passage 106 is sized to be equal to the width of valve spool lands 82, and the spacing between valve spool ring advance passages 104 and valve spool ring retard passages 106 matches the spacing between valve spool lands 82. Valve spool lands 82 engage the inner circumference of valve spool ring 102 to substantially prevent oil from passing between the interfaces of valve spool lands 82 and valve spool ring 102 while allowing valve spool 28 to rotate within valve spool ring 102 substantially uninhibited. Consequently, supply chambers 84 and vent chambers 86 are fluidly segregated and fluid communication into and out of advance chambers 42 and retard chambers 44 is substantially prevented when valve spool lands 82 are aligned with valve spool ring advance passages 104 and valve spool ring retard passages 106 to block valve spool ring advance passages 104 and valve spool ring retard passages 106.

Operation of camshaft phaser 12 will now be described with continued reference to FIGS. 1-3 and now with additional reference to FIGS. 4A-5D. The rotational position of rotor 20 relative to stator 18 is determined by the rotational position of valve spool 28 relative to stator 18. When the rotational position of rotor 20 relative to stator 18 is at a desired position to achieve desired operational performance of internal combustion engine 10, the rotational position of valve spool 28 relative to stator 18 is maintained constant by actuator 100. Consequently, a hold position as shown in FIG. 3 is defined when each valve spool land 82 is aligned with a respective valve spool ring advance passage 104 or a respective valve spool ring retard passage 106, thereby preventing fluid communication into and out of advance chambers 42 and retard chambers 44 and hydraulically locking the rotational position of rotor 20 relative to stator 18. In this way, the phase relationship between camshaft 14 and the crankshaft of internal combustion engine 10 is maintained.

Figure 4A:
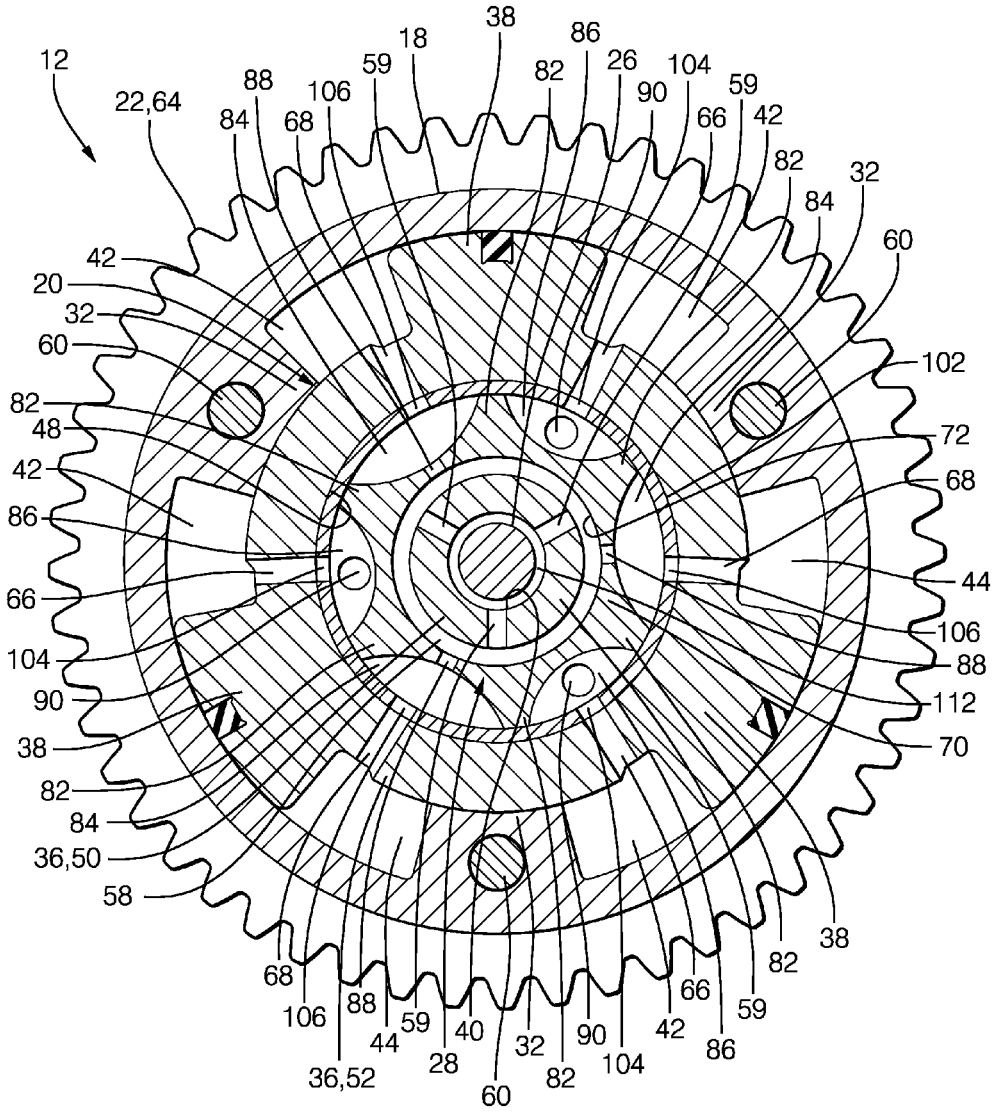
FIG. 4A is a radial cross-sectional view of the camshaft phaser showing the valve spool in a position which will result in a clockwise rotation of the rotor relative to the stator.
Figure 4B:
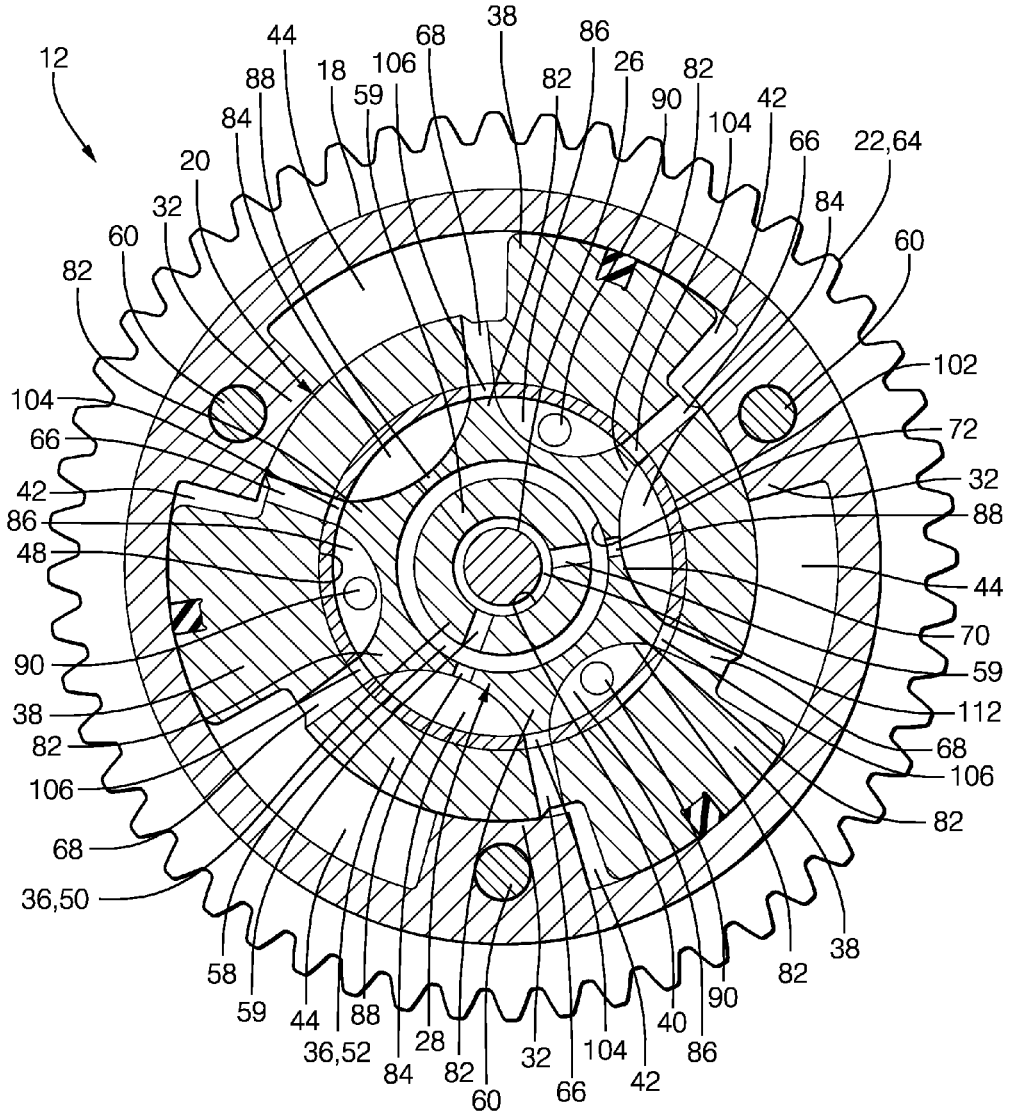
FIG. 4B is a radial cross-sectional view of the camshaft phaser showing the rotor after being rotated clockwise as a result of the position of the valve spool as shown in FIG. 4A.
Figure 4C:
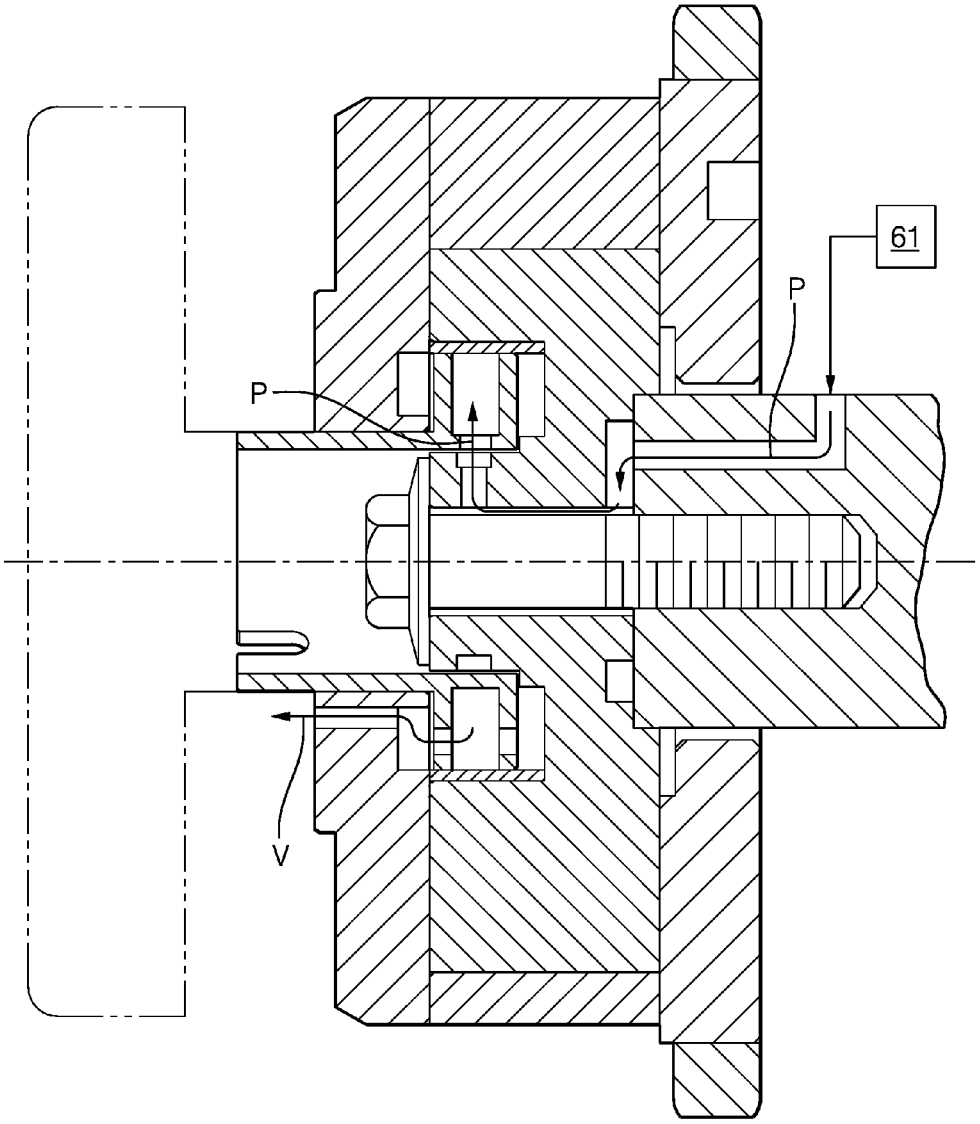
FIG. 4C is the axial cross-sectional view of FIG. 2 with reference numbers removed in order to clearly shown the path of oil flow as a result of the position of the valve spool as shown in FIG. 4A.
Figure 4D:
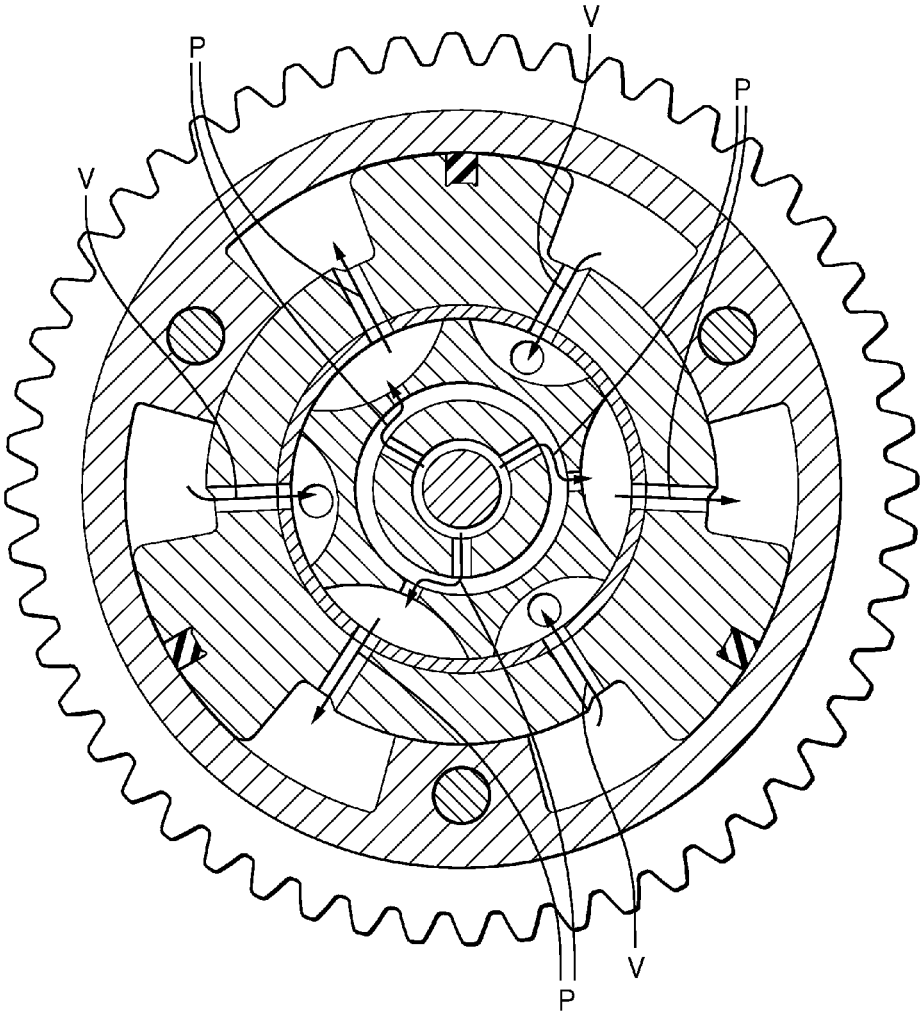
FIG. 4D is the radial cross-sectional view of FIG. 4A with reference numbers removed in order to clearly shown the path of oil flow as a result of the position of the valve spool as shown in FIG. 4A.

As shown in FIGS. 4A-4D, if a determination is made to advance the phase relationship between camshaft 14 and the crankshaft, it is necessary to rotate rotor 20 clockwise relative to stator 18 as viewed in the figures and as embodied by camshaft phaser 12. In order to rotate rotor 20 to the desired rotational position relative to stator 18, actuator 100 causes valve spool 28 to rotate clockwise relative to stator 18 to a rotational position of valve spool 28 relative to stator 18 that will also determine the rotational position of rotor 20 relative to stator 18. When valve spool 28 is rotated clockwise relative to stator 18, valve spool lands 82 are moved out of alignment with valve spool ring advance passages 104 and valve spool ring retard passages 106, thereby providing fluid communication between supply chambers 84 and retard chambers 44 and also between vent chambers 86 and advance chambers 42. Consequently, pressurized oil from oil source 61 is communicated to retard chambers 44 via an oil gallery 108 of internal combustion engine 10, a camshaft oil passage 110 formed in camshaft 14, an annular oil passage 112 formed radially between camshaft phaser attachment bolt 26 and rotor central through bore 40, rotor oil supply passages 59, rotor annular oil supply groove 58, spool supply passages 88, supply chambers 84, valve spool ring retard passages 106, and rotor retard passages 68. Also consequently, oil is vented out of camshaft phaser 12 from advance chambers 42 via rotor advance passages 66, valve spool ring advance passages 104, vent chambers 86, outer vent passages 94, annular front cover vent groove 96, and a front cover vent passage 114 which extends axially from annular front cover vent groove 96 to the axial face of front cover 24 that does not mate with rotor 20. Oil continues to be supplied to retard chambers 44 and vented from advance chambers 42 until rotor 20 is rotationally displaced sufficiently far for each valve spool land 82 to again align with respective valve spool ring advance passages 104 and valve spool ring retard passages 106 as shown in FIG. 4B, thereby again preventing fluid communication into and out of advance chambers 42 and retard chambers 44 and hydraulically locking the rotational position of rotor 20 relative to stator 18. In FIGS. 4C and 4D, which are the same cross-sectional views of FIGS. 2 and 4A respectively, the reference numbers have been removed for clarity, and arrows representing the path of travel of oil have been included where arrows P represent oil being supplied to retard chambers 44 from oil source 61 and arrows V represent oil being vented out of camshaft phaser 12 from advance chambers 42.

Figure 5A:
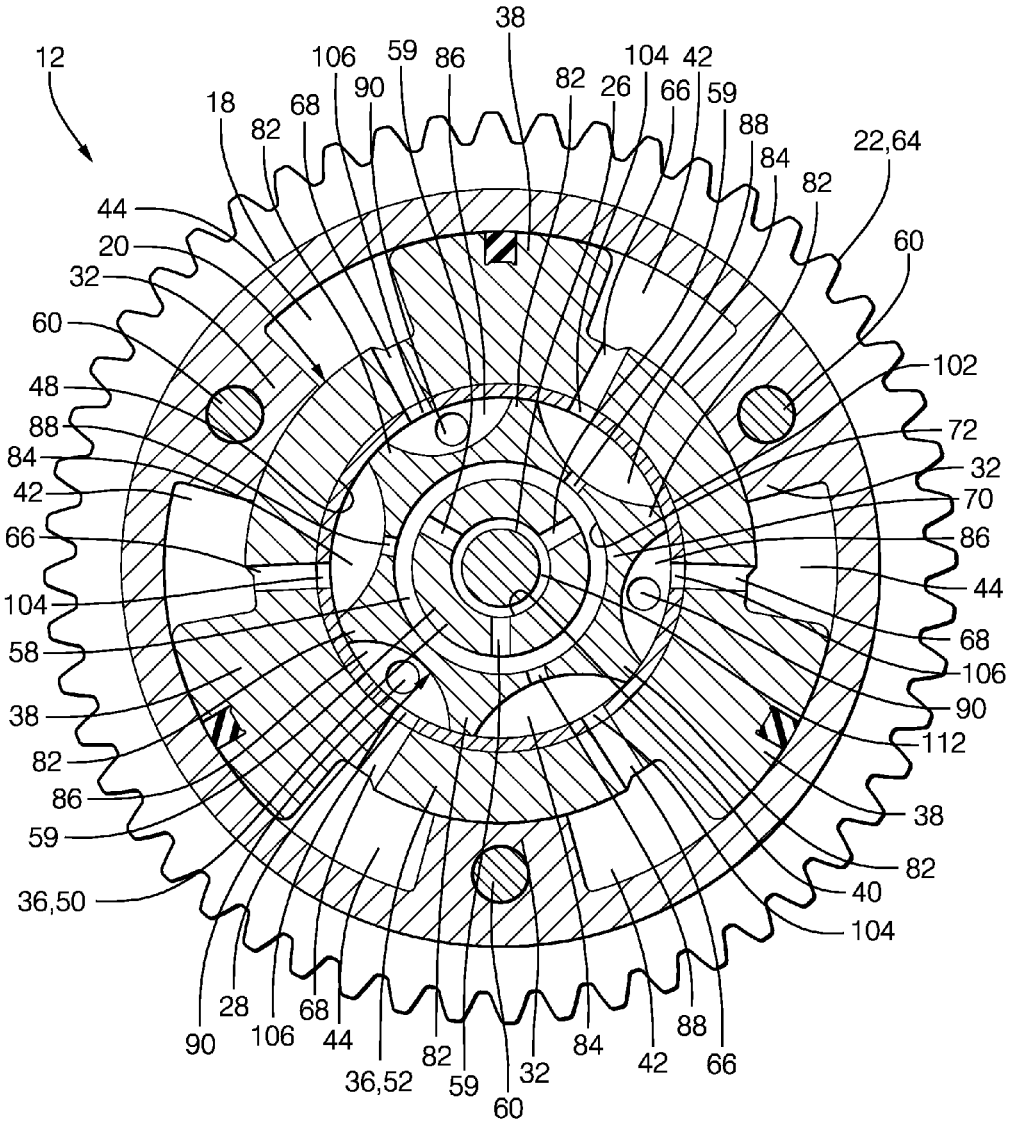
FIG. 5A is a radial cross-sectional view of the camshaft phaser showing the valve spool in a position which will result in a counterclockwise rotation of the rotor relative to the stator.
Figure 5B:
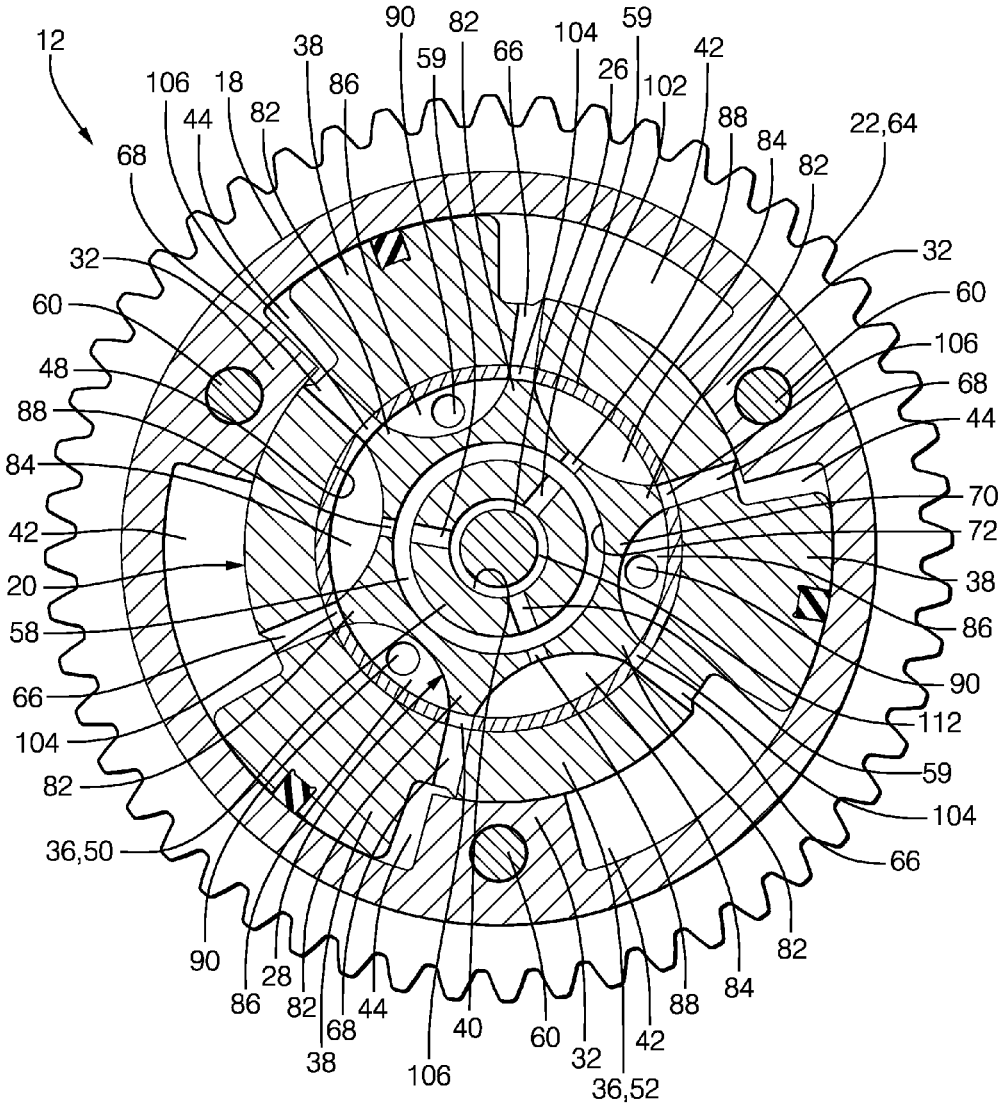
FIG. 5B is a radial cross-sectional view of the camshaft phaser showing the rotor after being rotated counterclockwise as a result of the position of the valve spool as shown in FIG. 5A.
Figure 5C:
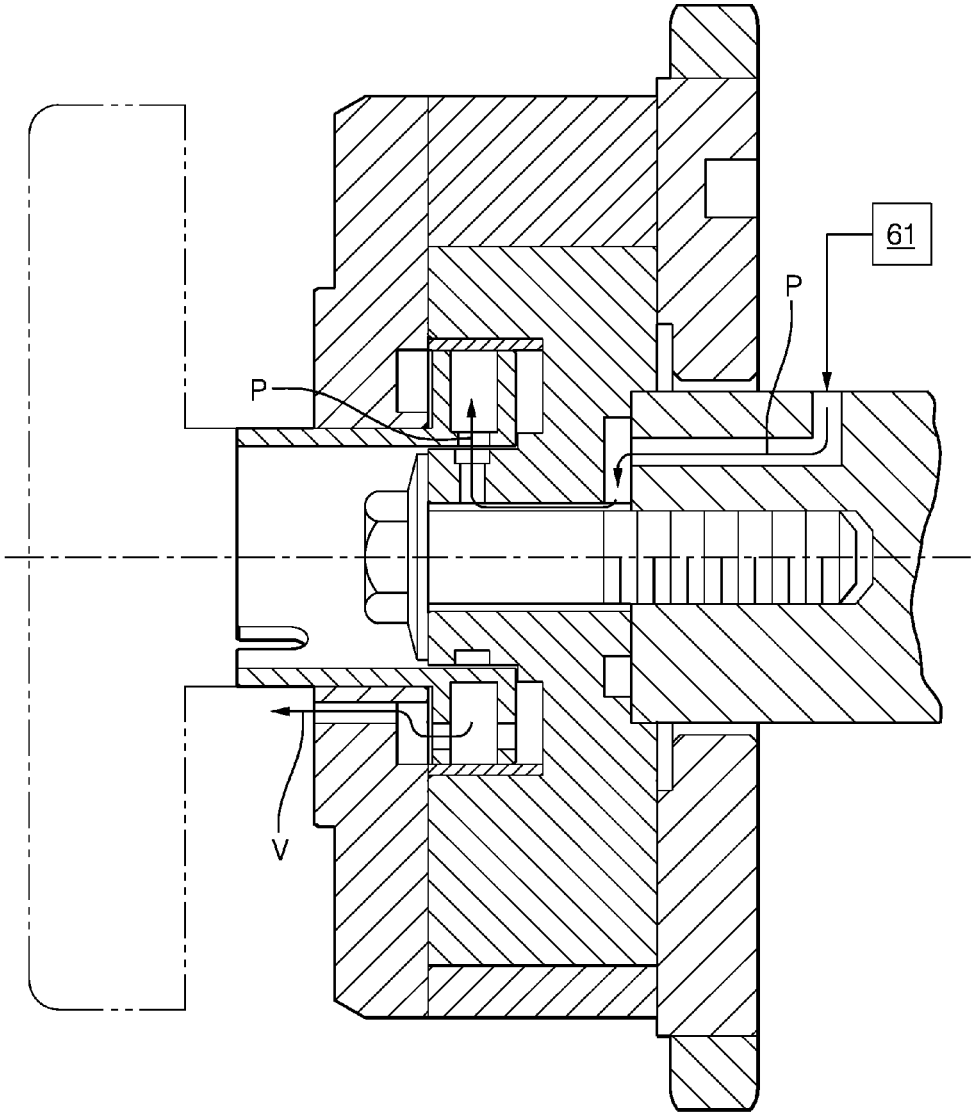
FIG. 5C is the axial cross-sectional view of FIG. 2 with reference numbers removed in order to clearly shown the path of oil flow as a result of the position of the valve spool as shown in FIG. 5A.
Figure 5D:
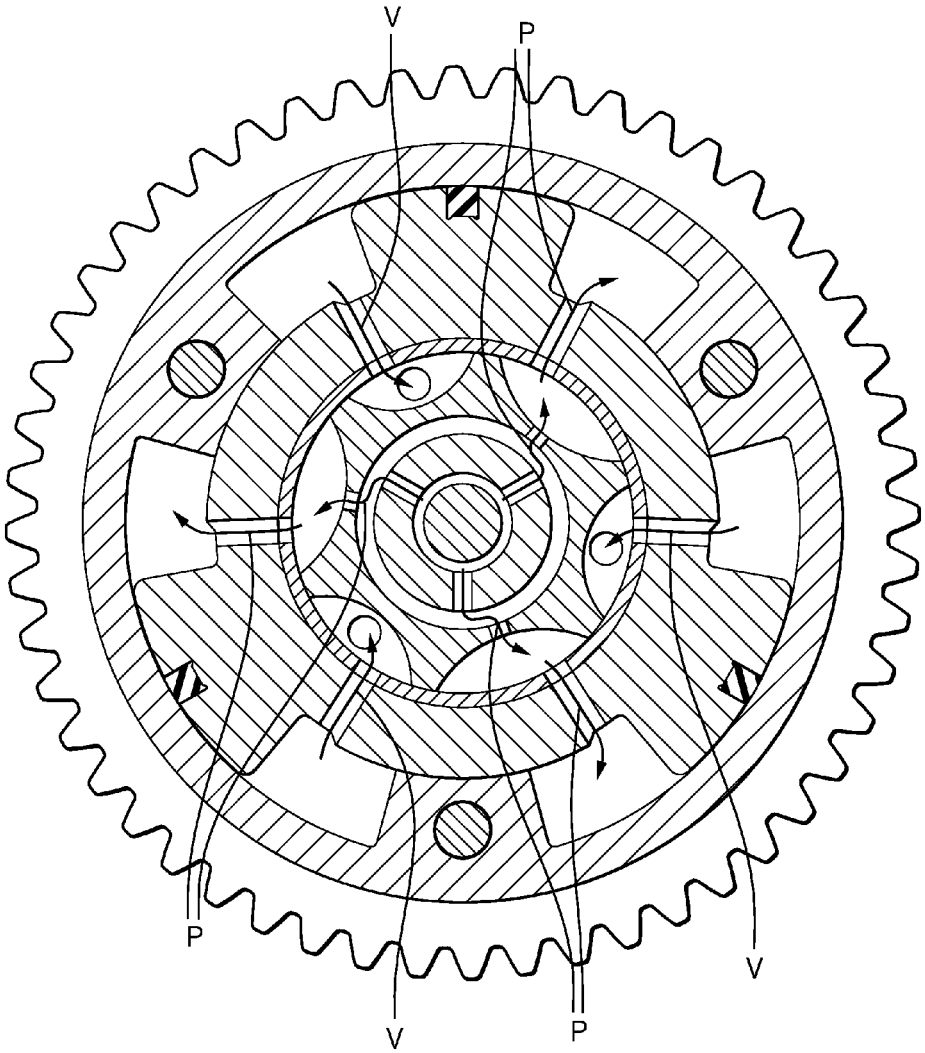
FIG. 5D is the radial cross-sectional view of FIG. 5A with reference numbers removed in order to clearly shown the path of oil flow as a result of the position of the valve spool as shown in FIG. 5A.

Conversely, as shown in FIGS. 5A-5D, if a determination is made to retard the phase relationship between camshaft 14 and the crankshaft, it is necessary to rotate rotor 20 counterclockwise relative to stator 18 as viewed in the figures and as embodied by camshaft phaser 12. In order to rotate rotor 20 to the desired rotational position relative to stator 18, actuator 100 causes valve spool 28 to rotate counterclockwise relative to stator 18 to a rotational position of valve spool 28 relative to stator 18 that will also determine the rotational position of rotor 20 relative to stator 18. When valve spool 28 is rotated counterclockwise relative to stator 18, valve spool lands 82 are moved out of alignment with valve spool ring advance passages 104 and valve spool ring retard passages 106, thereby providing fluid communication between supply chambers 84 and advance chambers 42 and also between vent chambers 86 and retard chambers 44. Consequently, pressurized oil from oil source 61 is communicated to advance chambers 42 via oil gallery 108, camshaft oil passage 110, annular oil passage 112, rotor oil supply passages 59, rotor annular oil supply groove 58, spool supply passages 88, supply chambers 84, valve spool ring advance passages 104, and rotor advance passages 66. Also consequently, oil is vented out of camshaft phaser 12 from retard chambers 44 via rotor retard passages 68, valve spool ring retard passages 106, vent chambers 86, outer vent passages 94, annular front cover vent groove 96, and front cover vent passage 114. Oil continues to be supplied to advance chambers 42 and vented from retard chambers 44 until rotor 20 is rotationally displaced sufficiently far for each valve spool land 82 to again align with respective valve spool ring advance passages 104 and valve spool ring retard passages 106 as shown in FIG. 5B, thereby again preventing fluid communication into and out of advance chambers 42 and retard chambers 44 and hydraulically locking the rotational position of rotor 20 relative to stator 18. In FIGS. 5C and 5D, which are the same cross-sectional views as FIGS. 2 and 5A respectively, the reference numbers have been removed for clarity, and arrows representing the path of travel of oil have been included where arrows P represent oil being supplied to advance chambers 42 from oil source 61 and arrows V represent oil being vented out of camshaft phaser 12 from retard chambers 44.

In operation, the actual rotational position of rotor 20 relative to stator 18 may drift over time from the desired rotational position of rotor 20 relative to stator 18, for example only, due to leakage from advance chambers 42 and/or retard chambers 44. Leakage from advance chambers 42 and/or retard chambers 44 may be the result of, by way of non-limiting example only, manufacturing tolerances or wear of the various components of camshaft phaser 12. An important benefit of valve spool 28 is that valve spool 28 allows for self-correction of the rotational position of rotor 20 relative to stator 18 if the rotational position of rotor 20 relative to stator 18 drifts from the desired rotational position of rotor 20 relative to stator 18. Since the rotational position of valve spool 28 relative to stator 18 is locked by actuator 100, valve spool ring advance passages 104 and valve spool ring retard passages 106 will be moved out of alignment with valve spool lands 82 when rotor 20 drifts relative to stator 18. Consequently, pressurized oil will be supplied to advance chambers 42 or retard chambers 44 and oil will be vented from advance chambers 42 or retard chambers 44 as necessary to rotate rotor 20 relative to stator 18 to correct for the drift until each valve spool land 82 is again aligned with respective valve spool ring advance passages 104 and valve spool ring retard passages 106.

It should be noted that inner vent passages 90 do not contribute to venting oil from advance chambers 42 or retard chambers 44. Instead, inner vent passages 90 ensure that opposing axial ends of valve spool 28 are at a common pressure, thereby preventing hydraulic pressure from applying an axial load to valve spool 28.

While camshaft phaser 12 have been described as including valve spool ring 102, it should now be understood that valve spool ring 102 may be omitted. If valve spool ring 102 is omitted, then valve spool lands 82 interface directly with the surface of annular valve spool recess 48 defined by rotor central hub outer portion 52. Furthermore, rotor advance passages 66 and rotor retard passages 68 need to be equal to the width of valve spool lands 82 when valve spool ring 102 is omitted, and the spacing between rotor advance passages 66 and rotor retard passages 68 matches the spacing between valve spool lands 82.

While clockwise rotation of rotor 20 relative to stator 18 has been described as advancing camshaft 14 and counterclockwise rotation of rotor 20 relative to stator 18 has been described as retarding camshaft 14, it should now be understood that this relationship may be reversed depending on whether camshaft phaser 12 is mounted to the front of internal combustion engine 10 (shown in the figures) or to the rear of internal combustion engine 10.

While this invention has been described in terms of preferred embodiments thereof, it is not intended to be so limited, but rather only to the extent set forth in the claims that follow.

I claim:

1. A camshaft phaser for use with an internal combustion engine for controllably varying the phase relationship between a crankshaft and a camshaft in said internal combustion engine, said camshaft phaser comprising:

an input member connectable to said crankshaft of said internal combustion engine to provide a fixed ratio of rotation between said input member and said crankshaft;

an output member connectable to said camshaft of said internal combustion engine and defining an advance chamber and a retard chamber with said input member;

a valve spool coaxially disposed within said output member such that said valve spool is rotatable relative to said output member and said input member, said valve spool defining a supply chamber and a vent chamber with said output member; and an actuator which rotates said valve spool in order to change the position of said output member relative to said input member by 1) supplying pressurized oil from said supply chamber to said advance chamber and venting oil from said retard chamber to said vent chamber when retarding the phase relationship of said camshaft relative to said crankshaft is desired and 2) supplying pressurized oil from said supply chamber to said retard chamber and venting oil from said advance chamber to said vent chamber when advancing the phase relationship between said camshaft relative to said crankshaft is desired;

wherein:

said input member is a stator having a plurality of lobes;

said output member is a rotor coaxially disposed within said stator, said rotor having a plurality of vanes interspersed with said lobes;

said advance chamber is one of a plurality of advance chambers defined by said plurality of vanes and said plurality of lobes;

said retard chamber is one of a plurality of retard chambers defined by said plurality of vanes and said plurality of lobes;

said supply chamber is one of a plurality of supply chambers defined with said rotor and said vent chamber is one of a plurality of vent chambers defined with said rotor such that said plurality of supply chambers are arranged in an alternating pattern with said plurality of vent chambers;

said rotor includes a rotor central hub from which said plurality of vanes extend radially outward therefrom, said rotor central hub having a rotor central through bore extending axially therethrough;

said rotor central hub defines an annular valve spool recess coaxially therein such that said annular valve spool recess divides said rotor central hub into a rotor central hub inner portion and a rotor central hub outer portion; and said valve spool is rotatably located coaxially within said annular valve spool recess.

2. A camshaft phaser as in claim 1 wherein:

said valve spool includes a spool central hub with a spool central through bore extending coaxially therethrough; and said spool central through bore is sized to mate with said rotor central hub inner portion in a close sliding interface such that said valve spool is able to freely rotate on said rotor central hub inner portion while substantially preventing oil from passing between the interface of said spool central through bore and said rotor central hub inner portion.

3. A camshaft phaser as in claim 2 where a plurality of valve spool lands are circumferentially spaced and extend radially outward from said spool central hub such that said plurality of supply chambers and said plurality of vent chambers are separated by said plurality of valve spool lands.

4. A camshaft phaser as in claim 3 wherein:

an annular spool base extends radially outward from said spool central hub;

an annular spool top extends radially outward from said spool central hub such that said annular spool top is axially spaced from said annular spool base; and said plurality of valve spool lands join said annular spool base to said annular spool top, thereby defining said plurality of supply chambers and said plurality of vent chambers axially between said annular spool base and said annular spool top.

5. A camshaft phaser as in claim 4 wherein said annular spool top includes a plurality of vent passages such that each one of said plurality of vent passages provide a path for oil to exit a respective one of said plurality of vent chambers.

6. A camshaft phaser as in claim 5 where each of said plurality of vent passages extend axially through said annular spool top.

7. A camshaft phaser as in claim 5 wherein said camshaft phaser further comprises:

a back cover closing one axial end of said stator;

a front cover closing the other axial end of said stator such that said plurality of advance chambers and said plurality of retard chambers are defined axially between said back cover and said front cover;

wherein said annular spool base and said annular spool top are captured axially between said annular valve spool recess and said front cover.

8. A camshaft phaser as in claim 7 wherein said front cover includes an annular front cover vent groove in fluid communication with sail plurality of vent passages of said annular spool top.

9. A camshaft phaser as in claim 8 wherein said front cover includes a front cover vent passage which provides fluid communication from said annular front cover vent groove out of said camshaft phaser.

10. A camshaft phaser as in claim 3 wherein said plurality of valve spool lands selectively prevent fluid communication between 1) said plurality of supply chambers and said plurality of advance chambers, 2) said plurality of vent chambers and said plurality of advance chambers, 3) said plurality of supply chambers and said plurality of retard chambers, and 4) said plurality of vent chambers and said plurality of retard chambers.

11. A camshaft phaser as in claim 3 wherein:

said rotor includes a rotor oil groove which receives pressurized oil from an oil source; and said spool central hub includes a plurality of spool supply passages such that each one of said plurality of spool supply passages provides fluid communication between said rotor oil groove and a respective one of said plurality of supply chambers.

12. A camshaft phaser as in claim 2 wherein said camshaft phaser further comprises:

a back cover closing one axial end of said stator;

a front cover closing the other axial end of said stator such that said plurality of advance chambers and said plurality of retard chambers are defined axially between said back cover and said front cover, said front cover having a front cover central bore extending coaxially therethrough;

wherein said valve spool includes a valve spool drive extension which extends axially through said front cover central bore such that said valve spool drive extension engages said actuator.

13. A camshaft phaser as in claim 1 wherein:

said rotor central hub outer portion includes a plurality of rotor advance passages extending radially therethrough such that each one of said plurality of rotor advance passages provides fluid communication between said annular valve spool recess and a respective one of said plurality of advance chambers; and said rotor central hub outer portion includes a plurality of rotor retard passages extending radially therethrough such that each one of said plurality of rotor retard passages provides fluid communication between said annular valve spool recess and a respective one of said plurality of retard chambers.

14. A camshaft phaser for use with an internal combustion engine for controllably varying the phase relationship between a crankshaft and a camshaft in said internal combustion engine, said camshaft phaser comprising:

an input member connectable to said crankshaft of said internal combustion engine to provide a fixed ratio of rotation between said input member and said crankshaft;

an output member connectable to said camshaft of said internal combustion engine and defining an advance chamber and a retard chamber with said input member;

a valve spool coaxially disposed within said output member such that said valve spool is rotatable relative to said output member and said input member, said valve spool defining a supply chamber and a vent chamber with said output member; and an actuator which rotates said valve spool in order to change the position of said output member relative to said input member by 1) supplying pressurized oil from said supply chamber to said advance chamber and venting oil from said retard chamber to said vent chamber when retarding the phase relationship of said camshaft relative to said crankshaft is desired and 2) supplying pressurized oil from said supply chamber to said retard chamber and venting oil from said advance chamber to said vent chamber when advancing the phase relationship between said camshaft relative to said crankshaft is desired;

wherein:

said input member is a stator having a plurality of lobes;

said output member is a rotor coaxially disposed within said stator, said rotor having a plurality of vanes interspersed with said lobes;

said advance chamber is one of a plurality of advance chambers defined by said plurality of vanes and said plurality of lobes;

said retard chamber is one of a plurality of retard chambers defined by said plurality of vanes and said plurality of lobes;

said supply chamber is one of a plurality of supply chambers defined with said rotor and said vent chamber is one of a plurality of vent chambers defined with said rotor such that said plurality of supply chambers are arranged in an alternating pattern with said plurality of vent chambers:

said rotor includes a rotor central hub from which said plurality of vanes extend radially outward therefrom, said rotor central hub having a rotor central through bore extending axially therethrough; and said camshaft phaser further comprises a camshaft phaser attachment bolt extending coaxially through said rotor central through bore for clamping said rotor to said camshaft, wherein said valve spool radially surrounds said camshaft phaser attachment bolt.

15. A camshaft phaser for use with an internal combustion engine for controllably varying the phase relationship between a crankshaft and a camshaft in said internal combustion engine, said camshaft phaser comprising:

an input member connectable to said crankshaft of said internal combustion engine to provide a fixed ratio of rotation between said input member and said crankshaft;

an output member connectable to said camshaft of said internal combustion engine and defining an advance chamber and a retard chamber with said input member;

a valve spool coaxially disposed within said output member such that said valve spool is rotatable relative to said output member and said input member, said valve spool defining a supply chamber and a vent chamber with said output member; and an actuator which rotates said valve spool in order to change the position of said output member relative to said input member by 1) supplying pressurized oil from said supply chamber to said advance chamber and venting oil from said retard chamber to said vent chamber when retarding the phase relationship of said camshaft relative to said crankshaft is desired and 2) supplying pressurized oil from said supply chamber to said retard chamber and venting oil from said advance chamber to said vent chamber when advancing the phase relationship between said camshaft relative to said crankshaft is desired;

wherein:

said input member is a stator having a plurality of lobes;

said output member is a rotor coaxially disposed within said stator, said rotor having a plurality of vanes interspersed with said lobes;

said advance chamber is one of a plurality of advance chambers defined by said plurality of vanes and said plurality of lobes;

said retard chamber is one of a plurality of retard chambers defined by said plurality of vanes and said plurality of lobes;

said supply chamber is one of a plurality of supply chambers defined with said rotor and said vent chamber is one of a plurality of vent chambers defined with said rotor such that said plurality of supply chambers are arranged in an alternating pattern with said plurality of vent chambers; and said valve spool includes a spool central hub with a plurality of valve spool lands extending radially outward from said spool central hub such that said plurality of supply chambers and said plurality of vent chambers are separated by said plurality of valve spool lands.

16. A camshaft phaser for use with an internal combustion engine for controllably varying the phase relationship between a crankshaft and a camshaft in said internal combustion engine, said camshaft phaser comprising:

an input member connectable to said crankshaft of said internal combustion engine to provide a fixed ratio of rotation between said input member and said crankshaft;

an output member connectable to said camshaft of said internal combustion engine and defining an advance chamber and a retard chamber with said input member;

a valve spool coaxially disposed within said output member such that said valve spool is rotatable relative to said output member and said input member, said valve spool defining a supply chamber and a vent chamber with said output member; and an actuator which rotates said valve spool in order to change the position of said output member relative to said input member by 1) supplying pressurized oil from said supply chamber to said advance chamber and venting oil from said retard chamber to said vent chamber when retarding the phase relationship of said camshaft relative to said crankshaft is desired and 2) supplying pressurized oil from said supply chamber to said retard chamber and venting oil from said advance chamber to said vent chamber when advancing the phase relationship between said camshaft relative to said crankshaft is desired;

wherein:

said input member is a stator having a plurality of lobes;

said output member is a rotor coaxially disposed within said stator, said rotor having a plurality of vanes interspersed with said lobes;

said advance chamber is one of a plurality of advance chambers defined by said plurality of vanes and said plurality of lobes;

said retard chamber is one of a plurality of retard chambers defined by said plurality of vanes and said plurality of lobes;

said supply chamber is one of a plurality of supply chambers defined with said rotor and said vent chamber is one of a plurality of vent chambers defined with said rotor such that said plurality of supply chambers are arranged in an alternating pattern with said plurality of vent chambers;

a hold position of said valve spool relative to said rotor blocks fluid communication between said plurality of supply chambers and said plurality of advance chambers and said plurality of retard chambers and also blocks fluid communication between said plurality of vent chambers and said plurality of advance chambers and said plurality of retard chambers, thereby preventing rotation of said rotor relative to said stator;

clockwise rotation of said valve spool relative to said stator causes said rotor to rotate clockwise relative to said stator and clockwise relative to said valve spool by opening passages between said plurality of supply chambers and said plurality of advance chambers or said plurality of retard chambers and by opening passages between said plurality of vent chambers and 1) said plurality of advance chambers if said plurality of supply chambers are opened to said plurality of retard chambers and 2) said plurality of retard chambers if said plurality of supply chambers are opened to said plurality of advance chambers until said rotor is in said hold position relative to said valve spool; and counterclockwise rotation of said valve spool relative to said stator causes said rotor to rotate counterclockwise relative to said stator and counterclockwise relative to said valve spool by opening passages between said plurality of supply chambers and the other of said plurality of advance chambers said plurality of retard chambers and by opening passages between said plurality of vent chambers and 1) said plurality of advance chambers if said plurality of supply chambers are opened to said plurality of retard chambers and 2) said plurality of retard chambers if said plurality of supply chambers are opened to said plurality of advance chambers until said rotor is in said hold position relative to said valve spool.

17. A camshaft phaser for use with an internal combustion engine for controllably varying the phase relationship between a crankshaft and a camshaft in said internal combustion engine, said camshaft phaser comprising:

an input member connectable to said crankshaft of said internal combustion engine to provide a fixed ratio of rotation between said input member and said crankshaft;

an output member connectable to said camshaft of said internal combustion engine and defining an advance chamber and a retard chamber with said input member;

a valve spool coaxially disposed within said output member such that said valve spool is rotatable relative to said output member and said input member, said valve spool defining a supply chamber and a vent chamber with said output member; and an actuator which rotates said valve spool in order to change the position of said output member relative to said input member by 1) supplying pressurized oil from said supply chamber to said advance chamber and venting oil from said retard chamber to said vent chamber when retarding the phase relationship of said camshaft relative to said crankshaft is desired and 2) supplying pressurized oil from said supply chamber to said retard chamber and venting oil from said advance chamber to said vent chamber when advancing the phase relationship between said camshaft relative to said crankshaft is desired wherein:

said input member is a stator having a plurality of lobes;

said output member is a rotor coaxially disposed within said stator, said rotor having a plurality of vanes interspersed with said lobes;

said advance chamber is one of a plurality of advance chambers defined by said plurality of vanes and said plurality of lobes;

said retard chamber is one of a plurality of retard chambers defined by said plurality of vanes and said plurality of lobes; and axial movement of said valve spool relative to said rotor is substantially prevented.

* * * * *